US006299951B1

(12) United States Patent
Dauner

(10) Patent No.: US 6,299,951 B1
(45) Date of Patent: Oct. 9, 2001

(54) TRUCK HUB PAINT MASK DEVICE

(76) Inventor: Aaron D. Dauner, 301-16th St. North, Unit B, Moorhead, MN (US) 56560

( * ) Notice: Subject to any disclaimer, the term of this patent is extended or adjusted under 35 U.S.C. 154(b) by 0 days.

(21) Appl. No.: 09/507,607

(22) Filed: Feb. 21, 2000

(51) Int. Cl.[7] ..... B05C 21/00

(52) U.S. Cl. ..... 428/35.7; 428/99; 428/34.1; 118/505

(58) Field of Search ..... 428/34.1, 99, 35.7; 118/505; 301/37.42, 37.1

(56) References Cited

U.S. PATENT DOCUMENTS

D. 239,754 * 5/1976 Yoder ..... 118/504
5,328,723 * 7/1994 Horiki et al. ..... 118/504
5,435,630 * 7/1995 Tucker ..... 301/37.1

* cited by examiner

*Primary Examiner*—Alexander S. Thomas
(74) *Attorney, Agent, or Firm*—Michael S. Neustel

(57) ABSTRACT

A truck hub paint mask device for protecting the hub of an axle during painting the rim of a tire. The inventive device includes cover having at least one wall, an opening, and an end member. A lumen is defined within the inner surface of the wall wherein the lumen is capable of being fit about the hub. The cover preferably includes a recessed area adjacent the end member along with a handle attached to the end member for allowing easy installation and removal of the cover from about a hub. The cover is constructed of a resilient high-density polyethylene plastic for allowing the cover to be manually deformed for allowing dried paint to be removed.

10 Claims, 5 Drawing Sheets

TRUCK HUB PAINT MASK DEVICE

BACKGROUND OF THE INVENTION

1. Field of the Invention

The present invention relates generally to paint masking and more specifically it relates to a truck hub paint mask device for protecting the hub of an axle during painting the rim of a tire and providing a convenient storage device for supplies.

Conventional semi-trucks have four separate hubs in the rear portion of the vehicle that rotatably support corresponding tires with rims. The hubs are typically painted black or a color similar to the body of the semi-truck. The rim of the tire is usually painted white, gray or silver. Painting the rims while still positioned upon the hubs of a semi-truck is a difficult and time-consuming task. Hence, there is a need for a masking system that reduces the amount of time required to paint the rims of a semi-truck.

2. Description of the Prior Art

Paint masking devices have been in use for years. Typically, paint masking devices for tires comprise a ring structure that surrounds the rubber tire thereby protecting the tire during painting of the rim. However, it is often times desirable to either not paint the hub or to paint the hub a separate color. Painters are thereby required to wrap conventional masking paper about the hub and attempt to tape the masking paper near the rim to avoid removing the entire tire from the vehicle or trailer. It is difficult to properly secure the masking tape about the hub with paint from the rim often times engaging the hub.

Examples of patented masking devices for tires and rims include U.S. Pat. Nos. 3,192,896 to Irving; 4,811,991 to Moreno et al.; 5,423,599 to Sherod et al.; 5,667,590 to Simons, Sr.; D340439 to Carbone; D338185 to Dowd which are all illustrative of such prior art.

While these devices may be suitable for the particular purpose to which they address, they are not as suitable for protecting the hub of an axle during painting the rim of a tire. Conventional masking devices do not provide a convenient masking device for protecting the hub of a vehicle from paint while painting the rim of a tire.

In these respects, the truck hub paint mask device according to the present invention substantially departs from the conventional concepts and designs of the prior art, and in so doing provides an apparatus primarily developed for the purpose of protecting the hub of an axle during painting the rim of a tire.

SUMMARY OF THE INVENTION

In view of the foregoing disadvantages inherent in the known types of masking devices now present in the prior art, the present invention provides a new truck hub paint mask device construction wherein the same can be utilized for protecting the hub of an axle during painting the rim of a tire.

The general purpose of the present invention, which will be described subsequently in greater detail, is to provide a new truck hub paint mask device that has many of the advantages of the masking devices mentioned heretofore and many novel features that result in a new truck hub paint mask device which is not anticipated, rendered obvious, suggested, or even implied by any of the prior art masking devices, either alone or in any combination thereof.

To attain this, the present invention generally comprises at least one wall, an opening, and an end member. A lumen is defined within the inner surface of the wall wherein the lumen is capable of being fit about the hub. The cover preferably includes a recessed area adjacent the end member along with a handle attached to the end member for allowing easy installation and removal of the cover from about a hub. The cover is constructed of a resilient high-density polyethylene plastic for allowing the cover to be manually deformed for allowing dried paint to be removed.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a truck hub paint mask device that will overcome the shortcomings of the prior art devices.

A second object is to provide a truck hub paint mask device for protecting the hub of an axle during painting the rim of a tire.

Another object is to provide a truck hub paint mask device that protects the hub of a vehicle or trailer from paint while painting a rim.

An additional object is to provide a truck hub paint mask device that eliminates the need to remove the entire tire from the vehicle or trailer to avoid painting the hub.

A further object is to provide a truck hub paint mask device that is easily positioned and removed about a hub of a vehicle or trailer.

Another object is to provide a truck hub paint mask device that easily removes accumulated paint without utilizing harsh chemicals.

An additional object is to provide a truck hub paint mask device that also serves as a convenient storage container for supplies.

Another object is to provide a truck hub paint mask device that decreases the overall time required to paint the rims of a vehicle or trailer thereby reducing the overall labor and costs required to paint the rims.

A further object is to provide a truck hub paint mask device that is constructed of a high-density polyethylene plastic that resists deterioration from constant contact with harsh chemicals, paint thinner, solvents and paints.

An additional object is to provide a truck hub paint mask device that fits upon the hubs of most makes and models of vehicles.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DESCRIPTION OF THE PREFERRED EMBODIMENT

Figure 1:
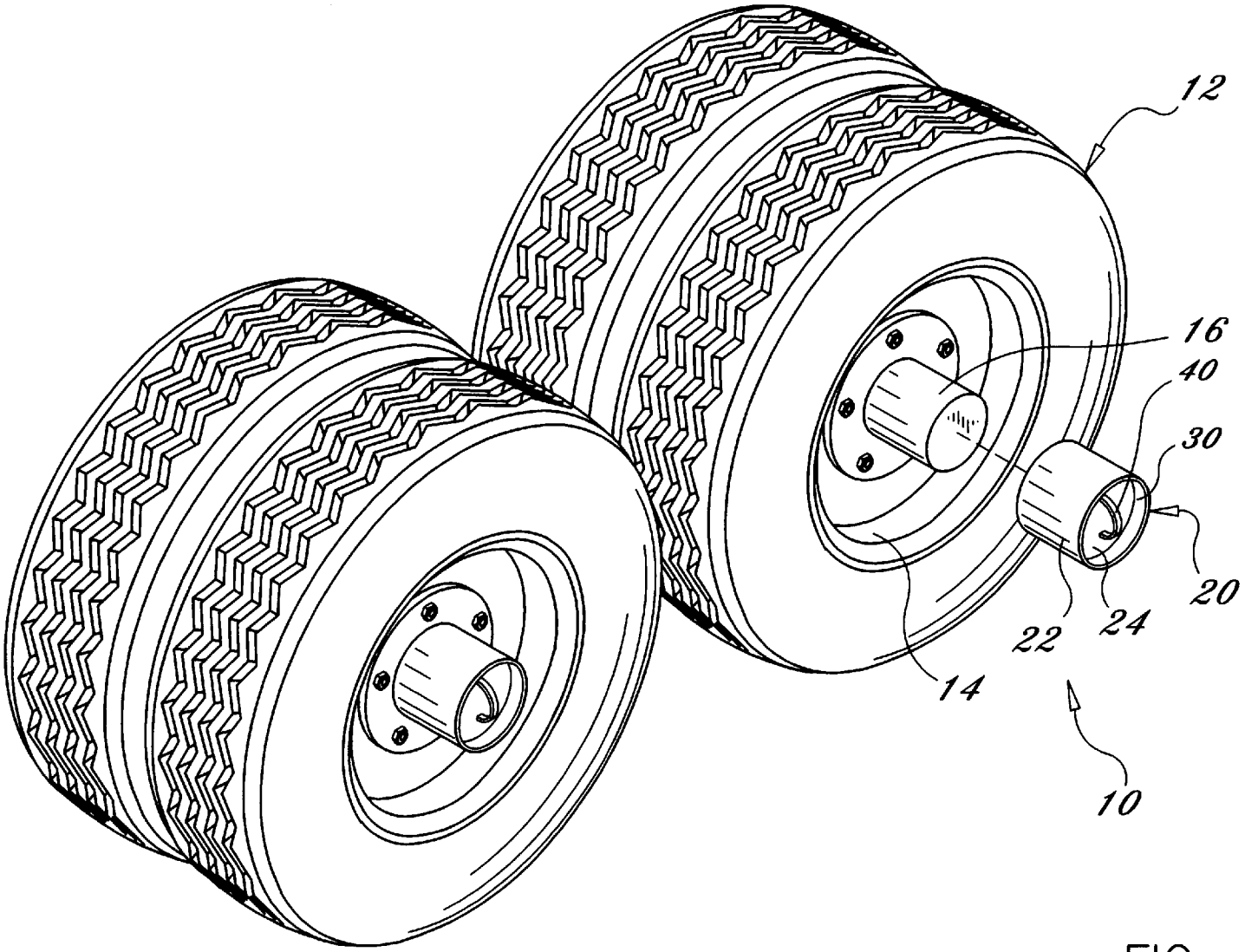
FIG. 1 is an exploded upper perspective view of the present invention with respect to a hub of a vehicle.

Turning now descriptively to the drawings, in which similar reference characters denote similar elements throughout the several views, FIGS. 1 through 9 illustrate a truck hub paint mask device 10, which comprises at least one wall 22, an opening 26, and an end member 24. A lumen 28 is defined within the inner surface of the wall 22 wherein the lumen 28 is capable of being fit about the hub 16. The cover 20 preferably includes a recessed area 30 adjacent the end member 24 along with a handle 40 attached to the end member 24 for allowing easy installation and removal of the cover 20 from about a hub 16. The cover 20 is constructed of a resilient high-density polyethylene plastic for allowing the cover 20 to be manually deformed for allowing dried paint to be removed.

Figure 2:
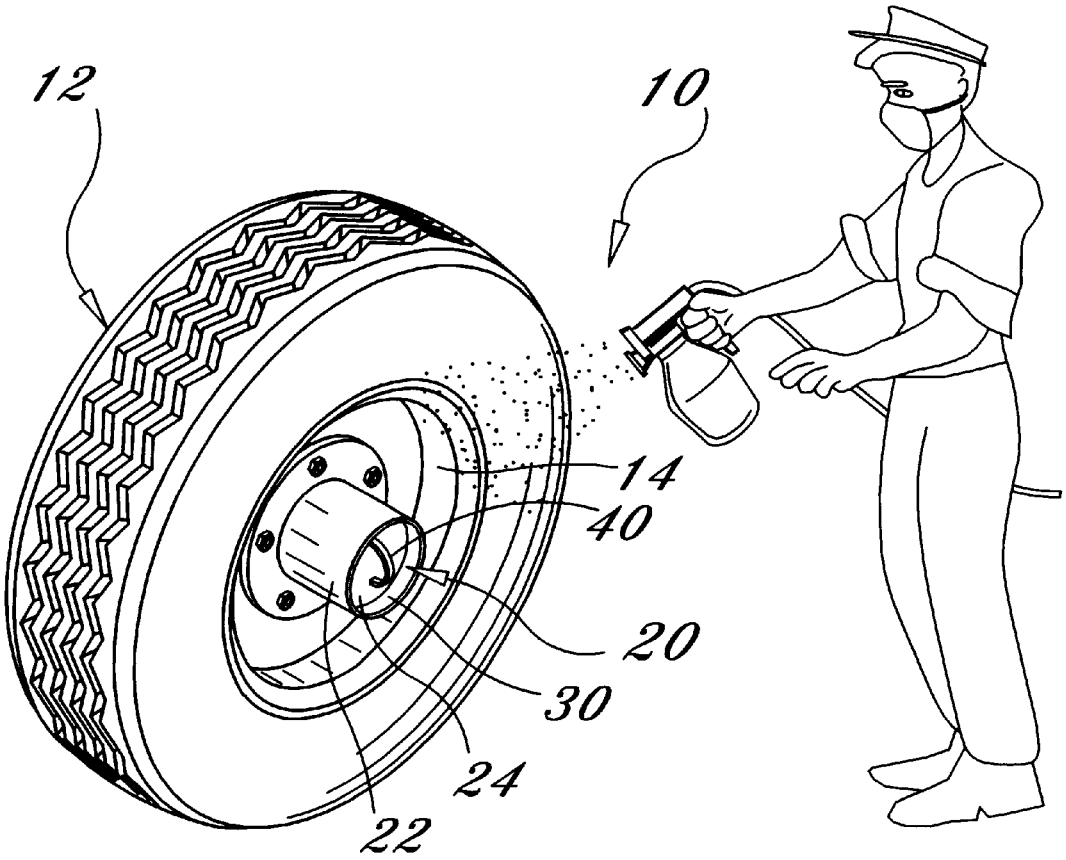
FIG. 2 is an upper perspective view of the present invention positioned about a hub of a vehicle.
Figure 3:
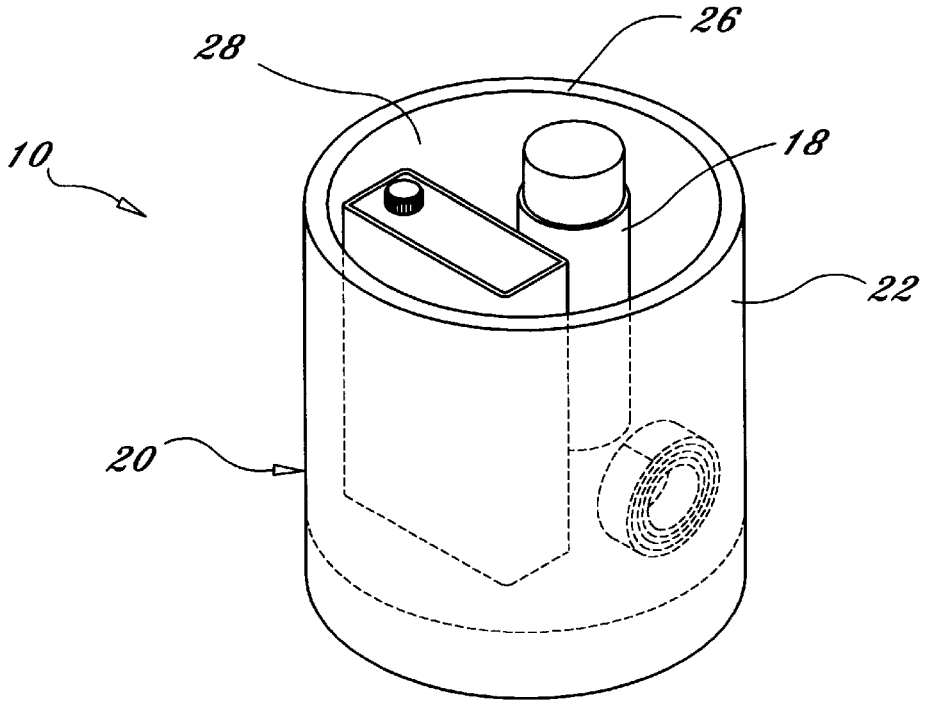
FIG. 3 is an upper perspective view of the present invention in an upright position with a plurality of supplies contained within.
Figure 4:
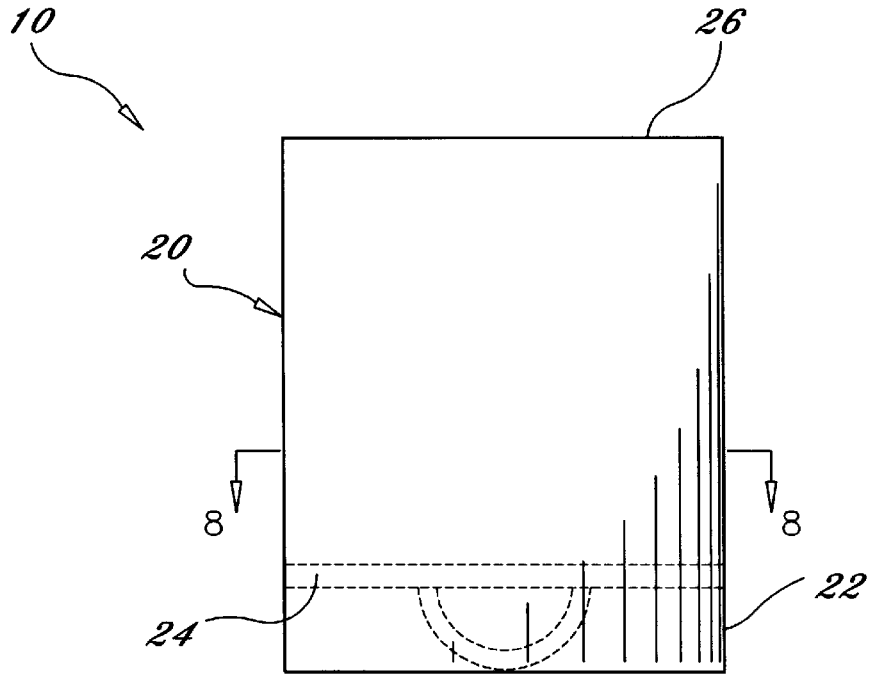
FIG. 4 is a side view of the present invention.
Figure 5:
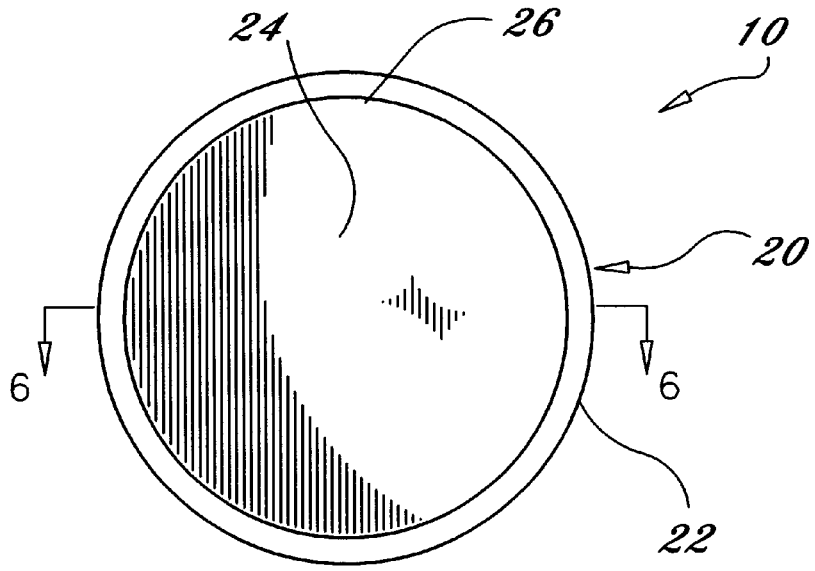
FIG. 5 is a top view of the preset invention.

As shown in FIGS. 1 through 3 of the drawings, the cover 20 is cylindrical shaped for fitting about a hub 16. The cover 20 may have any shape or structure thereto, however it is preferable to have a circular cross sectional shaped cover 20 to snugly fit about a hub 16. The cover 20 may be constructed of any well-known material, however the cover 20 is preferably constructed of a flexible and resilient material such as high-density polyethylene plastic. The cover 20 may be constructed of a material that is resilient to harsh chemicals and abrasives.

Figure 7:
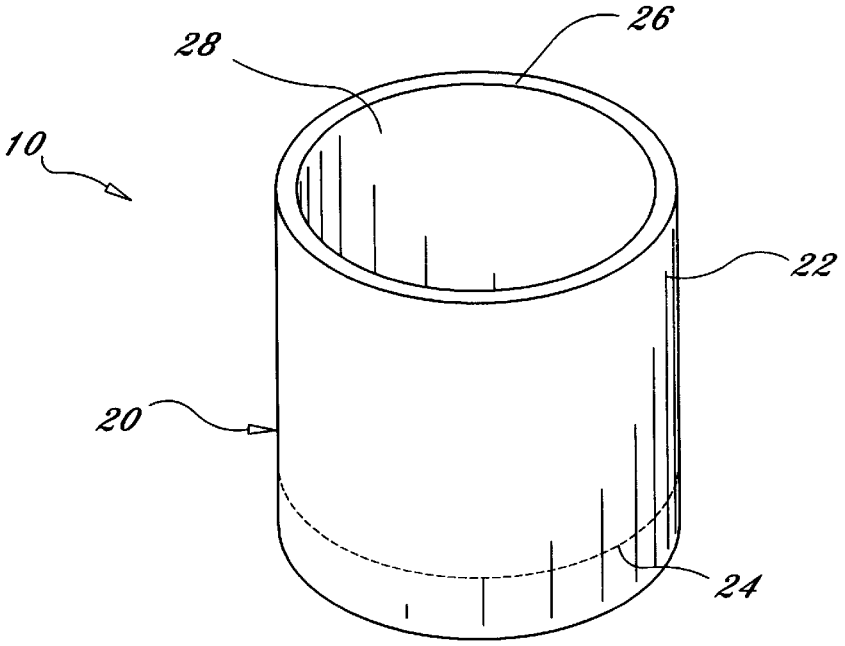
FIG. 7 is an upper perspective view of the present invention in an upright position.
Figure 8:
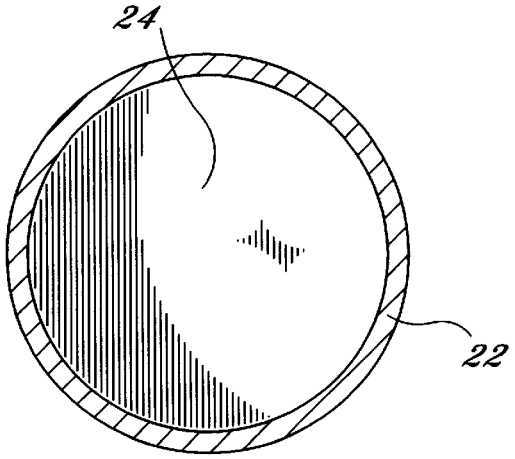
FIG. 8 is a cross sectional view taken along line 8—8 of FIG. 4.
Figure 9:
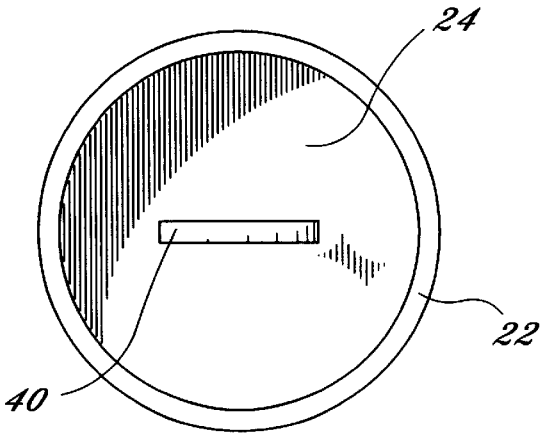
FIG. 9 is a bottom view of the present invention disclosing the recessed area and the handle secured within.

The cover 20 has an opening 26 at one end for receiving the hub 16 as best shown in FIGS. 3 and 7 of the drawings. The opening 26 is preferably circular in shape for snugly fitting about the hub 16 thereby preventing paint and other chemicals from engaging the hub 16. The opening 26 exposes a lumen 28 within the cover 20 that either snugly or loosely receives the hub 16.

As shown in FIGS. 1 through 9 of the drawings, the cover 20 further includes at least one wall 22. The wall 22 may have a circular cross sectional shape or various other well-known shapes. The inner surface of the wall 22 defines the lumen 28 of the cover 20 for receiving the hub 16.

An end member 24 is attached within the lumen 28 of the cover 20 for enclosing one end of the cover 20 opposite of the opening 26. As shown in FIGS. 1, 2, 6 and 9 of the drawings, a recessed area 30 exists between the end member 24 and the end of the cover 20 opposite of the opening 26.

Figure 6:
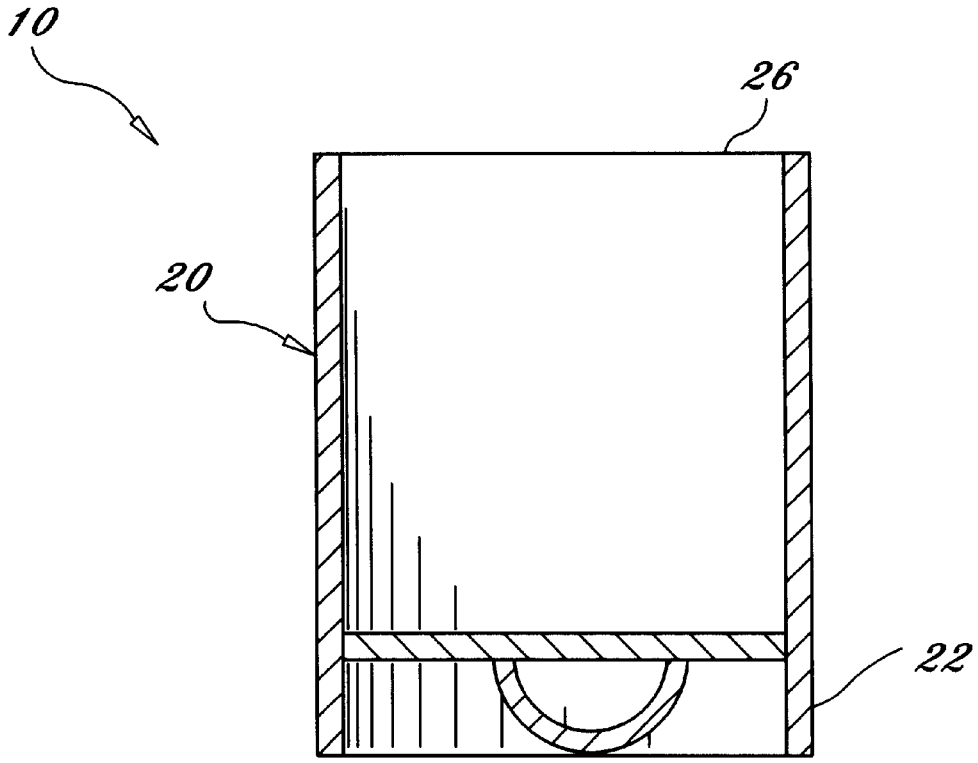
FIG. 6 is a cross sectional view taken along line 6—6 of FIG. 5.

At least one handle 40 is preferably attached to the end member 24 or the wall 22 within the recessed area 30 for allowing the user to easily install and remove the cover 20 from the hub 16 during painting. The handle 40 does not extend past the end of the cover 20 as best shown in FIG. 6 of the drawings for allowing the cover 20 to be vertically orientated for storing paint supplies 18 and other items.

Grasping the handle 40 and the cover 20, the user positions the opening 26 of the cover 20 adjacent the hub 16 to be protected as shown in FIG. 1 of the drawings. The user then positions the cover 20 about the hub 16 until the edge of the opening 26 engages the rim 14, wherein the opening 26 of the cover 20 snugly fits about the hub 16 for preventing paint and other chemicals from engaging the hub 16. The user then paints the rim 14 of the tire 12 as shown in FIG. 2 of the drawings. After the paint has dried, the user grasps the handle 40 and removes the cover 20 from the hub 16. The user then may manually grasp and squeeze the cover 20 thereby causing the cover 20 to flex which allows the paint to be flaked off. If any paint remains upon the cover 20, the user may utilize conventional chemicals to remove the paint without damaging the cover 20. The user then may position the cover 20 in a vertically orientated position upon a floor or shelf thereby allowing the user to position paint supplies 18 and other items within the cover 20 as shown in FIG. 3 of the drawings. When the user desires to paint a hub 16 again, they simply remove the paint supplies 18 and repeat the above procedure.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed to be within the expertise of those skilled in the art, and all equivalent structural variations and relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A truck hub paint mask device, comprising:

a cover having at least one wall, an opening, and an enclosed portion, wherein said cover is cylindrical for fitting about a hub;

a recessed area between said enclosed portion and an end opposite of said opening;

a handle attached to cover, wherein said handle is positioned within said recessed area;

wherein said cover is comprised of a resilient material.

2. The truck hub paint mask device of claim 1, wherein said opening fits snugly about said hub.

3. The truck hub paint mask device of claim 2, wherein said opening has a circular shape.

4. The truck hub paint mask device of claim 1, wherein said at least one wall has a circular cross sectional area.

5. The truck hub paint mask device of claim 1, wherein said cover is comprised of high-density polyethylene plastic.

6. A truck hub paint mask device, comprising:

a cover having at least one wall, an opening and a lumen, wherein said cover is cylindrical for fitting about a hub; and an end member attached within said cover opposite of said opening;

a recessed area between said end member and an end opposite of said opening;

a handle attached to cover, wherein said handle is positioned within said recessed area;

wherein said cover is comprised of a resilient material.

7. The truck hub paint mask device of claim 6, wherein said opening fits snugly about said hub.

8. The truck hub paint mask device of claim 7, wherein said opening has a circular shape.

9. The truck hub paint mask device of claim 6, wherein said at least one wall has a circular cross sectional area.

10. The truck hub paint mask device of claim 6, wherein said cover is comprised of high-density polyethylene plastic.

* * * * *